United States Patent [19]

Vinoskey

[11] 4,191,005

[45] Mar. 4, 1980

[54] CASE OPENING APPARATUS

[75] Inventor: Adam V. Vinoskey, Forest, Va.

[73] Assignee: Simplimatic Engineering Company, Lynchburg, Va.

[21] Appl. No.: 836

[22] Filed: Jan. 4, 1979

[51] Int. Cl.[2] ..... B65B 43/39

[52] U.S. Cl. ..... 53/382; 414/411

[58] Field of Search ..... 53/382; 414/411

[56] References Cited

U.S. PATENT DOCUMENTS

| | | | |
|---|---|---|---|
| 2,761,263 | 9/1956 | Bruce | 53/382 |
| 3,861,115 | 1/1975 | Peres | 53/382 X |

*Primary Examiner*—Travis S. McGehee

*Attorney, Agent, or Firm*—James & Franklin

[57] ABSTRACT

A carriage is mounted for movement along a track situated above, and generally parallel to, the case conveyor. When the case reaches a predetermined location, conveyor movement is terminated and the carriage is moved along the track by a pneumatic cylinder. Affixed to the side of the track is a rack having a plurality of gear teeth. The teeth of a pinion gear, situated on one end of a shaft extending from the carriage, operably engage the gear teeth of the rack. In this manner, the gear is rotated in accordance with carriage movement along the track. A flap engaging disc is operably connected to the other end of the shaft and situated adjacent the top of the case. Movement of the carriage along the track causes the disc to rotate as it is displaced relative to the case. As it moves, the disc engages the leading flap of the case and pivots same to an opened position.

19 Claims, 7 Drawing Figures

CASE OPENING APPARATUS

The present invention relates to a case opening apparatus and, more particularly, to a mechanism designed to open the leading flap of a case.

Various forms of automatic case packing equipment are well known in the art. In general, automatic case packing equipment includes an infeed conveyor which transports empty cases or cartons, usually composed of cardboard or the like, to a packing station, wherein bottles, jars or the like are placed in the case. The loaded case moves to a carton closing mechanism which closes and seals the flaps of the case. The case is then transferred along an out-feed conveyor to be palletized or removed individually for storage or shipping.

Since the cases are normally stored, prior to loading, with the flaps thereof closed but unsealed, it is necessary to open the case flaps prior to the packing operation. In an automated packer, therefore, apparatus must be provided for automatically opening the flaps of the case prior to the transfer of the case to the packing station. The case opening apparatus may be located on the infeed conveyor of the case packing equipment or on a separate conveyor which feeds the in-feed conveyor.

A case or carton has four flaps, designated for convenience by the direction of case movement along the conveyor, as the leading flap, the trailing flap, and a pair of side flaps. Because of the position of each of these types of flaps and the direction in which same must be moved in order to open same, separate mechanisms are normally provided to open each type of flap, the leading flap requiring one kind of opening mechanism, the side flaps requiring a second type of opening mechanism and the trailing flap requiring a third type of opening mechanism. It is well known in the art to use a plow to open the side flaps and a hook-type device to open the trailing flap. However, the design of the mechanism for opening the leading flap of the case presents special problems because the leading flap must be reliably engaged and thereafter moved in the same direction as the case movement, prior to disengagement.

In order to perform the leading flap opening operation, a variety of mechanisms of different designs have been utilized. Certain of these mechanisms utilize hook-type devices which, in timed relation with case movement along the conveyor, are pivoted in an arc to engage and open the flap as the case is moved. Other types employ a helically movable flap engaging member, a pin fixed to a rotating chain, or the like. However, none of these conventional mechanisms operate satisfactorily, either because of difficulties with respect to the engagement of the flap as the case is moved with respect to the flap opening mechanism, or because the flap, once engaged, is not reliably moved to the proper opened position. Further, these mechanisms tend to be complex in nature, having a large number of moving parts, including apparatus to coordinate the timing of the flap opening device with case movement. Thus, known leading flap opening mechanisms are normally relatively expensive to manufacture, require substantial maintenance, and take up a large amount of plant space.

It is, therefore, a prime object of the present invention to provide a case opening apparatus which will function reliably to engage and open the leading flap of a case.

It is another object of the present invention to provide a case opening apparatus which is simple in design and has a minimum number of moving parts.

It is a further object of the present invention to provide a case opening apparatus wherein the necessity for complicated timing mechanisms is eliminated by providing a flap engaging member which is movable with respect to a stationary case.

It is still another object of the present invention to provide a case opening apparatus wherein linear displacement and rotation of the flap engaging member relative to the case is achieved in a simplified manner.

It is a still further object of the present invention to provide a case opening apparatus including a member for opening the leading flap of the case which can be utilized in conjunction with devices designed for opening the side and trailing flaps of the case.

In accordance with the present invention, apparatus for opening the leading flap of a case or the like is provided. The apparatus comprises a track and a rack fixedly mounted on the track having a plurality of gear teeth. A carriage is mounted on the track. Means are provided for moving the carriage along the track. A pinion gear is freely rotatably mounted on the carriage in operable engagement with the rack, such that the gear is rotated as the carriage is moved. Flap engaging means are provided as are means for operably connecting the flap engaging means to the pinion for rotation therewith. As the carriage is moved relative to the track, the flap engaging means is rotated and displaced relative to the case to engage the leading flap and move same from the closed position to the opened position.

Means are provided for moving the case relative to the track, preferably in the form of a conveyor. Means for terminating case movement are actuated when the case is positioned for the leading flap opening operation. The track is located above the case and extends in a direction generally parallel to the direction of movement of the case along the case moving means. The connecting means, in the form of a shaft, extends from the carriage to a position over the upper surface of the case. At the end of the connecting shaft, the flap engaging means is mounted. The flap engaging means comprises a disc having flap engaging member and a flap clearance recess.

The flap clearance recess is defined by first and second surfaces. The first surface forms the upper portion of the flap engaging member, is generally linear in configuration, and is situated substantially perpendicular to the radius of the disc which passes through the junction between the first and second surfaces. The flap engaging member serves to engage the underside of the closed flap when the carriage is in the initial position. The second surface of the recess includes a generally linear section and an arcuate section. The generally linear section of the second surface is adjacent the first surface and forms an acute angle therewith. Preferably, the apex of the acute angle formed between the linear section of the second surface and the first surface has a rounded configuration to prevent binding of the peripheral edge of the flap. The arcuate section of the second surface provides clearance for the peripheral edge of the flap, as same is pivoted from the closed to the opened position by movement of the flap engaging member.

The apparatus for opening the leading flap of the case is designed for operation in conjunction with means for opening the side flaps of the case and means for opening the trailing flap of the case. Preferably, the means for opening the side flaps of the case comprises a stationary plow, and the means for opening the trailing flap of the case comprises a pivotable hook member.

To these and other objects as may hereinafter appear, the present invention relates to a case opening apparatus as described in the following specification, and set forth in the annexed claims, taken together with the accompanying drawings, wherein like numerals refer to like parts, and in which:

Figure 1:
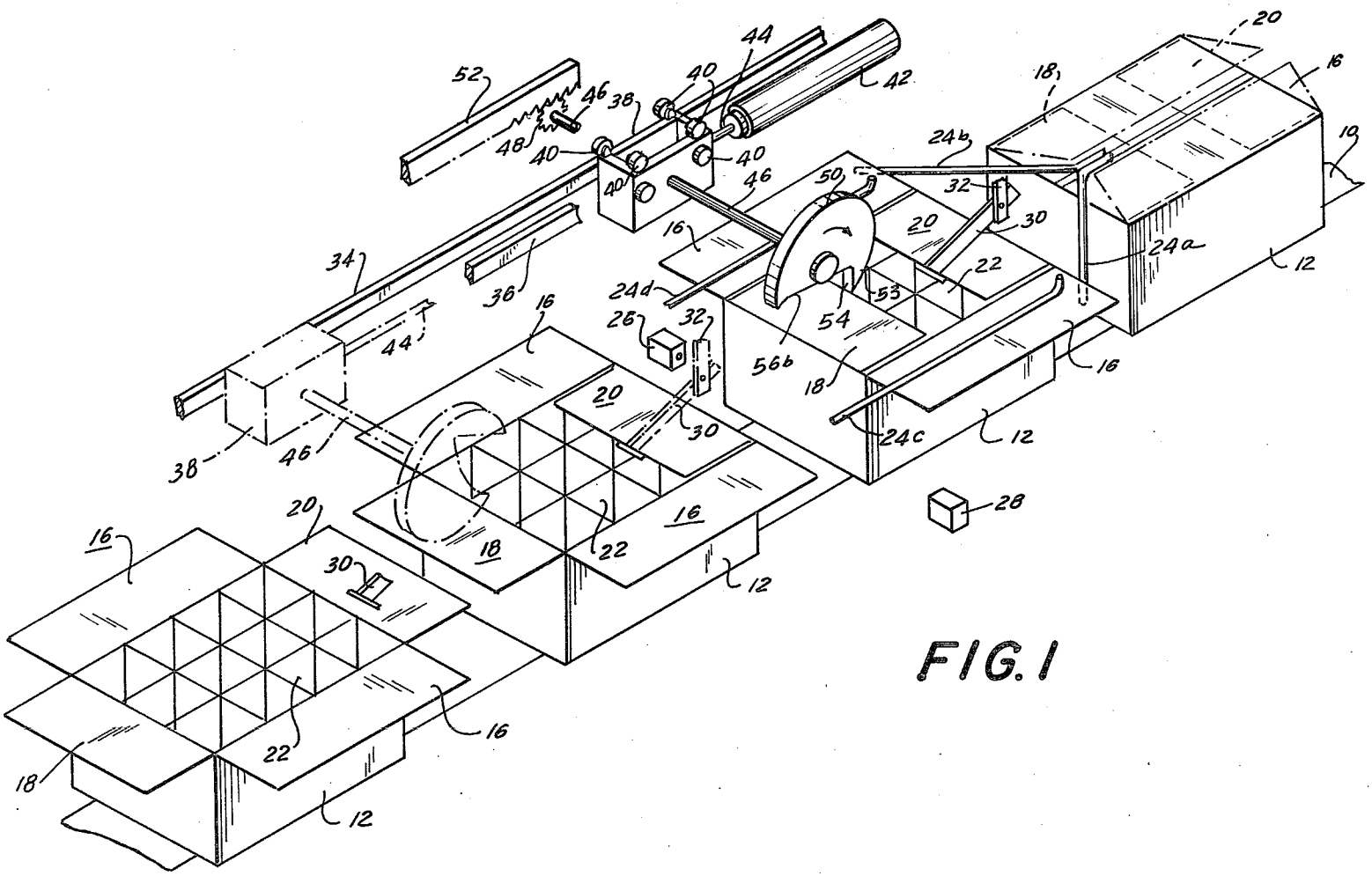
FIG. 1 is an isometric view of the case opening apparatus of the present invention, illustrating the sequence of flap opening operations.

As illustrated in the drawings, the case opening apparatus performs three separate flap opening operations. The first operation serves to open the side flaps of the case. This portion of the operation takes place as the case is moved along a conveyor relative to the case opening apparatus. After the side flaps are opened and the case reaches a predetermined location along the conveyor, movement of the conveyor is terminated and the case is held stationary with respect to the case opening apparatus, during the second operation, which serves to open the leading flap of the case. After completion of the second operation, the conveyor is again actuated to move the case relative to the case opening apparatus to perform the third operation, which is to open the trailing flap of the case.

The case opening apparatus is designed for use in conjunction with a conventional conveyor system, either comprising a horizontal endless belt of a pair of upstanding endless side belts, a combination of a horizontal belt and side belts or other known types of conveyors designed for case transport. For purposes of explanation, the case opening apparatus shown in the drawings utilizes both a horizontal endless belt 10 and a pair of upstanding side belts 14 spaced to engage opposite sides of the case. It is to be understood, however, that the particular design of the conveyor system used in conjunction with the case opening apparatus forms no part of the present invention.

The belts 10 and 14 are powered by either a single electric motor or separate electric motors (not shown). However, the movement of the belts is coordinated such that actuation and deactuation thereof occurs simultaneously. When actuated, the belts serve to move a case with respect to the case opening apparatus from the right to the left, as seen in the drawings. Upstanding belts 14 are positioned to engage the case at opposite sides thereof to prevent lateral movement of the case. The positions of belts 14 may be made adjustable to accommodate cases of different sizes.

Case 12 has a pair of side flaps 16, a leading flap 18 and a trailing flap 20. Inside the carton is situated an interlocking partition 22 of known design which divides the interior of the case 12 into a plurality of compartments, into which bottles, jars or the like will be loaded.

Figure 2:
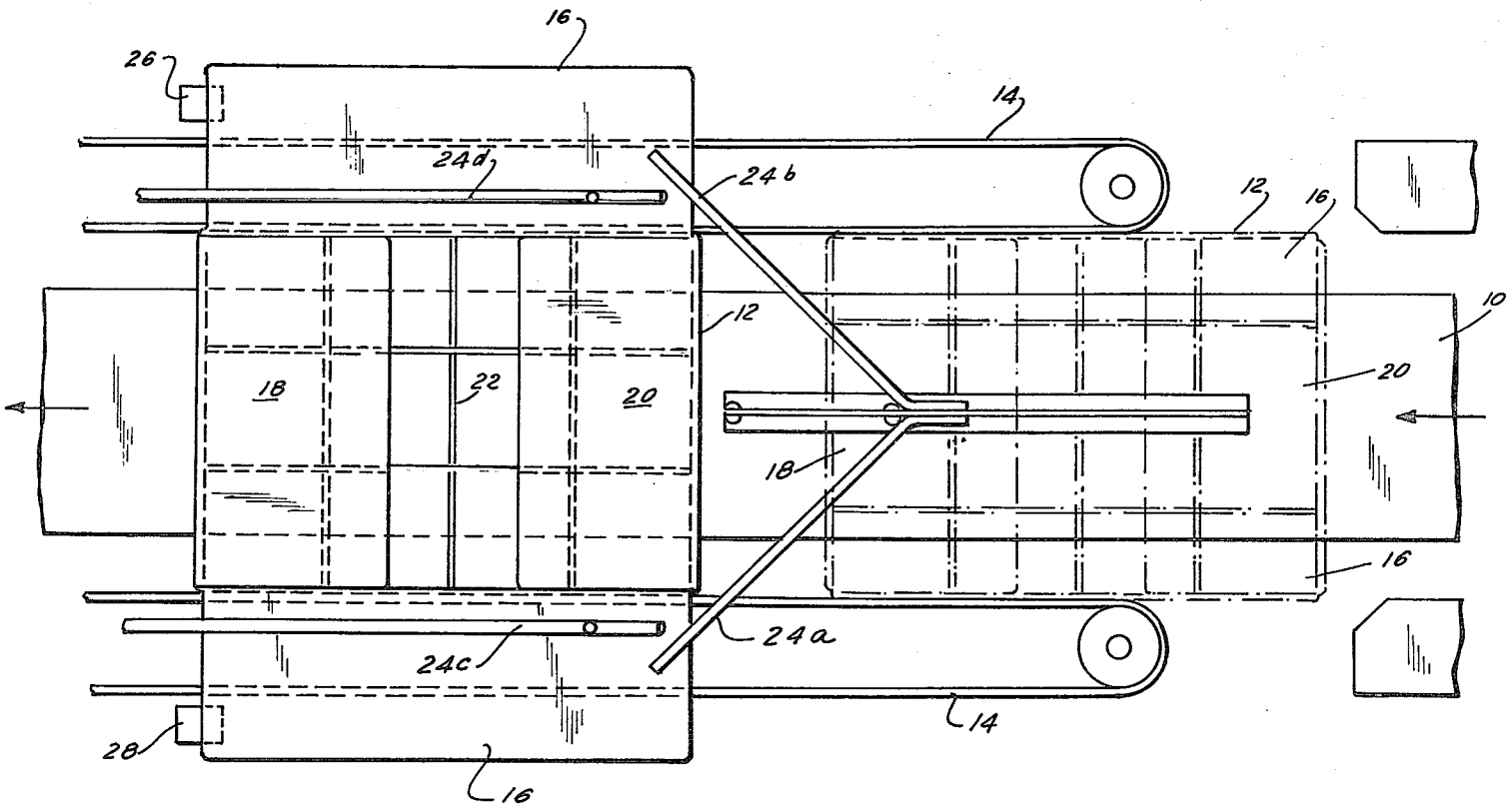
FIG. 2 is a top elevational view of a case opening apparatus of the present invention, illustrating the side flap opening operation.

As seen in FIGS. 1 and 2, the first operation of the case opening apparatus opens side flaps 16. The side flaps opening operation takes place during the actuation of conveyor belt 10 and, thus, is performed as the case is moved along belt 10 relative to the case opening apparatus. Side flaps 16 are opened by a plow 24 which is suspended over the top of the case from an overhead support frame, not shown.

Plow 24 includes a pair of side flap opening members *24a*, *24b* and a pair of side flap position maintaining members *24c* and *24d*. Members *24a* and *24b* are situated above belt 10 a distance equal to the case height and respectively extend from areas above the peripheries of belt 10 inwardly toward the center of the belt, and forwardly in a direction opposite to the direction of case movement, to form a "V"-shape. Members *24a* and *24b* come together at the forward end of the plow at a location in the plane of the top surface of case 12, in alignment with the separation between the side flaps 16. As case 12 is conveyed towards plow 24, the forward end of the plow is received beneath the side flaps 16. Further movement of the case causes members *24a* and *24b* to be received under the respective side flaps 16, such that same are located between the undersurface of the respective flaps and the top surface of leading flap 18. As case 12 continues to move relative to plow 24, members *24a* and *24b* cause the respective side flaps 16 to pivot outwardly until same are in a position generally perpendicular to the sides of the case. At this point, the leading edges of the respective side flaps 16 pass beneath side flap position maintaining members *24c*, *24d*, respectively. Position maintaining members *24c* and *24d* extend along the remainder of the case opening apparatus and serve to keep side flaps 16 in the opened position, such that the second and third operations, opening the leading flap 18 and the trailing flap 20, can take place without interference from the side flaps 16.

Figure 3:
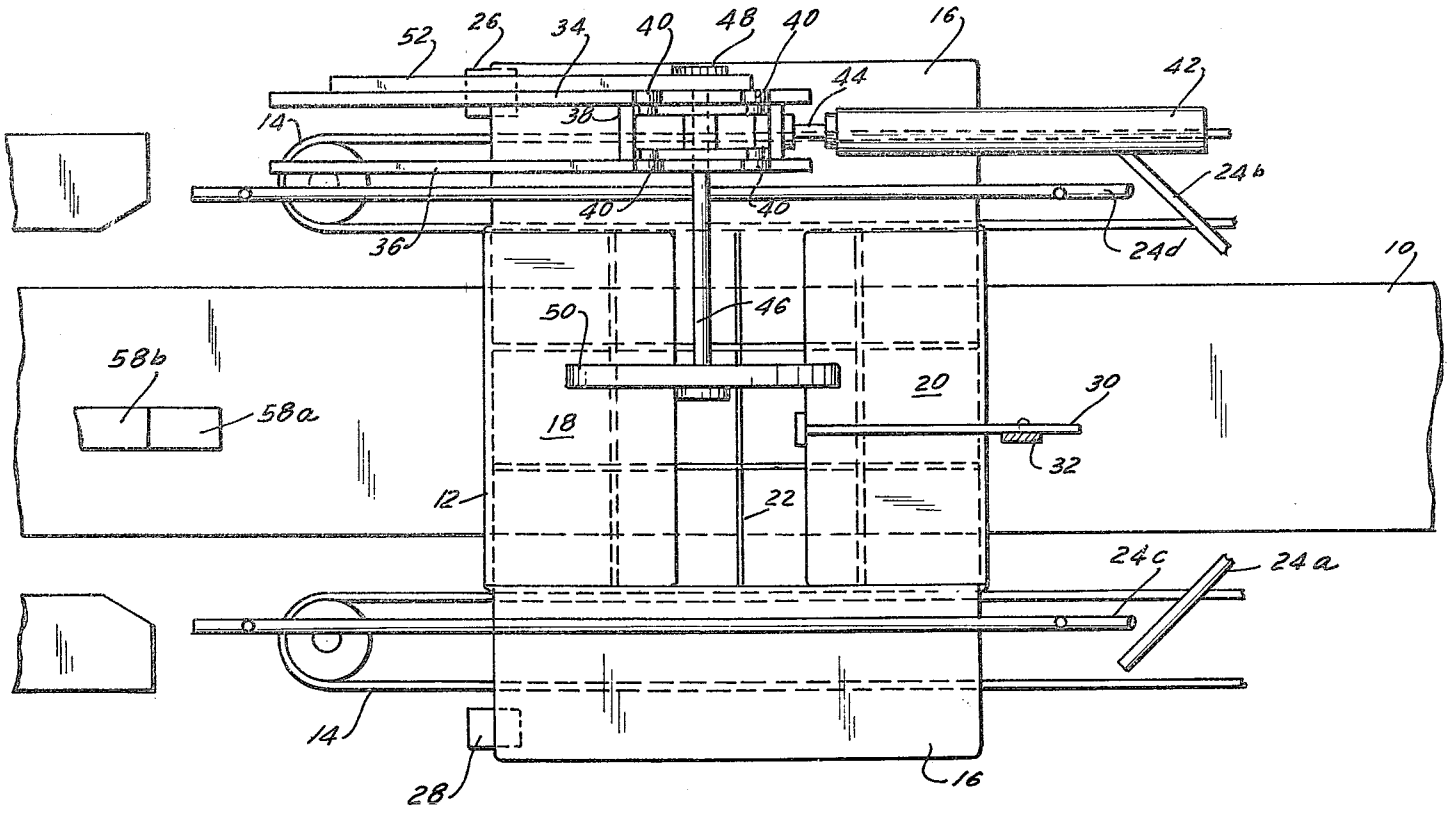
FIG. 3 is a top elevational view of the case opening apparatus of the present invention, illustrating the initial portion of the leading flap opening operation.
Figure 4:
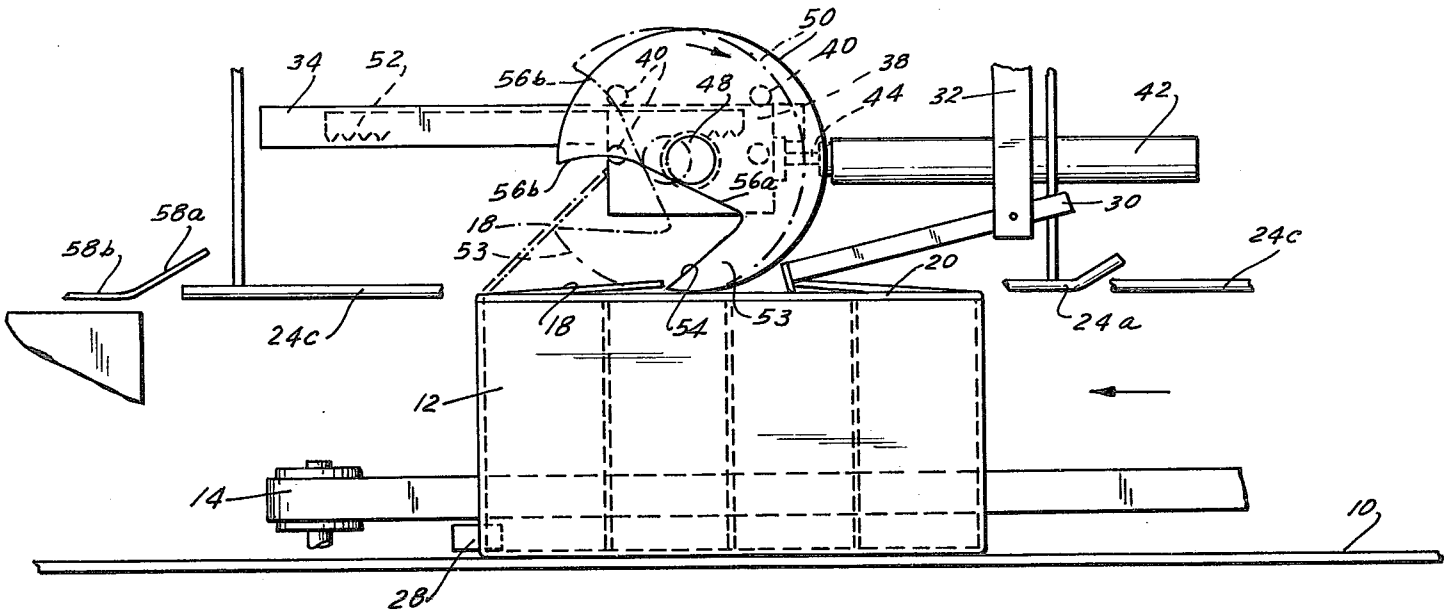
FIG. 4 is a side elevational view of the portion of the flap opening operation illustrated in FIG. 3.

Conveyor 10 continues to move case 12 until the case reaches the second position, shown in FIGS. 1 and 2, which is the position shown in FIGS. 3 and 4 of the drawings. At this position, the movement of the conveyor system is terminated and the case is maintained in a stationary position with respect to the case opening apparatus. The movement of conveyor belt 10 and conveyor belts 14 is controlled by a conventional case position sensing device, such as a limit switch located adjacent conveyor belt 10 with the actuator thereof intersecting the path of movement of case 12, or a conventional photo-sensitive switch. For purposes of explanation, the latter type of position sensing device is illustrated herein in the form of a light source 26 and a photo-sensitive switch 28, located at opposite sides of conveyor belt 10. When the forward end of case 12 is moved to a predetermined position along belt 10, the light beam normally directed from light source 26 to photo-sensitive switch 28 is interrupted, causing switch 28 to deactuate the electric drive for the conveyor system, such that case 12 is held in a stationary position. It is to be appreciated that the particular form of the case position sensing mechanism utilized forms no part of the present invention, and, any one of a variety of commercially available position sensing devices could be used to perform this function.

As can be best seen from FIGS. 3 and 4, when case 12 is correctly positioned for the initiation of the leading flap opening operation, a hook 30, pivotally mounted on an upstanding member 32, is suspended from an overhead support frame (not shown), engages the peripheral edge of trailing flap 20. In this position of carton 12, hook 30 has not moved trailing flap 20. However, when the conveyor system is reactuated, after the leading flap 18 has been opened as described in detail below, movement of case 12 relative to hook 30 will result in the opening of trailing flap 20.

The leading flap opening operation is performed by an apparatus, a portion of which is moved relative to case 12 while case 12 is held stationary with respect to conveyor belts 10 and 14.This apparatus comprises a pair of guide tracks 34, 36 mounted above and to one side of the path of movement of case 12 along conveyor 10. Tracks 34, 36 extend in a direction generally parallel to the direction of movement of conveyor belt 10 and are supported by an overhead support frame (not shown). Movably mounted on tracks 34, 36 is a carriage 38 which is provided, at either side thereof, with two pairs of rollers 40, between which the tracks are received, such that carriage 38 is freely movable along tracks 34, 36 between a first position, as shown in solid in FIG. 1, and in FIGS. 3 and 4, and a second position, shown in phantom in FIG. 1 and in FIGS. 5 and 6. Carriage 38 is movable along tracks 34, 36 between the first and second positions by means of a conventional air cylinder 42, or the like, which has an extendible piston rod 44 connected to carriage 38.

Air cylinder 42 is connected to a source of compressed air through an electrically operated valve (not shown) of conventional design which is actuated by photo-sensitive switch 28. Thus, when case 12 is conveyed to a predetermined position by conveyor 10, the movement of the conveyor system is terminated and the leading flap opening operation is initiated by the electrically operated valve which causes air to be fed to cylinder 42. As air is fed to cylinder 42, the piston within cylinder 42 is moved along the length of the cylinder so as to move piston rod 44 and, thus, carriage 38 along tracks 34, 36. Carriage 38 is moved from its initial position, wherein the leading flap opening operation commences, to a second position, wherein the leading flap opening operation is completed, and thereafter is automatically returned to the initial position. The return stroke of cylinder 42 is controlled by a conventional limit switch (not shown) which automatically causes a reversal of the movement of the piston within cylinder 42, in a conventional manner.

Carriage 38 has rotatably mounted thereon a shaft 46. One end of shaft 46 has fixedly mounted thereon a pinion gear 48. The other end of shaft 46 extends over carton 12 to a position approximately along the center line thereof and has fixedly mounted thereon a flap engaging disc 50. Mounted on the outside of track 34 is a rack 52 which comprises a plurality of downwardly directed gear teeth situated in meshing engagement with the gear teeth of pinion 48. Since rack 52 is fixedly mounted to the side of track 34, the movement of carriage 38 along tracks 34, 36 causes pinion 48 to rotate. As carriage 38 moves from the first position to the second position along tracks 34, 36, pinion gear 48 will rotate in a clockwise direction, as seen in FIG. 1. The clockwise rotation of pinion gear 48, as the carriage 38 moves from the first to the second position, causes a clockwise rotation of flap engaging disc 50. The rotation and displacement of flap engaging disc 50, caused by the movement of carriage 38 along tracks 34, 36 from the first to the second position, causes leading flap 18 of case 12 to be engaged by disc 50 and moved from its closed position to an opened position.

The structure of flap engaging disc 50 can best be appreciated from an examination of FIG. 4, which shows a side view of the disc. Disc 50 comprises a flap engaging member 53 and a flap clearance recess, the latter of which is defined between the top surface 54 of member 53 and a surface 56. Surface 54 is generally linear in configuration and extends in a direction substantially perpendicular to a radius of disc 50 extending from the axis of rotation thereof, through the junction between surraces 54 and 56, to the periphery of the disc, such that surface 54 forms a portion of a chord of the circle. Surface 56 comprises two sections; a generally linear section **56*a* and an arcuate section 56*b*. Linear section 56*a* is adjacent surface 54 and meets same to form an acute angle therewith. The apex of the angle formed between surface 54 and section 56*a* preferably has a rounded configuration so as to prevent binding of the peripheral edge of leading flap 18. Arcuate section 56*b* extends from linear section 56*a* to the periphery of disc 50. Arcuate section 56*b* is curved such that the peripheral edge of leading flap 18 will clear same as the flap is pivoted in an arc about the corner of case 12 from its closed position to its opened position by member 53**.

Flap engaging disc 50 is designed for use with cases of a variety of different sizes. Cases of different sizes have flaps and, specifically, leading flaps of different lengths. As used herein, the term "flap length" is defined as the distance between the fold line of the flap situated along the corner of the case from which the flap extends and the outer peripheral edge of the flap. Thus, the length of the leading flap is measured in a direction parallel to case movement.

Flap engaging disc 50 is designed to accommodate leading flaps within the range of from approximately 3 inches to approximately 8 inches in length. Thus, most standard case sizes can be accommodated without the necessity of changing the size or shape of the flap engaging disc. However, the position at which the case is stopped relative to disc 50 is determined by the length of the leading flap. This position is altered simply by adjusting the location of the case position sensing mechanism along the conveyor system such that conveyor movement is terminated at a point where the tip of flap engaging member 53 engages the peripheral edge of the leading flap, as illustrated in FIG. 4.

The size and shape of disc 50 must be selected such that the structure of flap engaging member 53 reliably causes engagement with the leading flap and maintains engagement therewith until the leading flap is in the opened position. However, the size and shape of the flap clearance recess defined between surfaces 54 and 56 is also important because this recess must provide clearance for all lengths of leading flaps up to approximately 8 inches, the upper limit of the design range. Moreover, it must be appreciated that the path of movement of the peripheral edge of the leading flap, as same is moved from the closed to the opened position, is an arc whose center is the fold line at the corner of the case about which the leading flap is pivoted. The shape of the recess must be designed to accommodate this movement.

FIG. 3 and the solid representation of disc 50 in FIG. 4 illustrate the position of disc 50 at the beginning of the leading flap opening operation, as well as the position of carriage 38 with respect to tracks 34, 36 at this time.

From FIG. 4, it is clear that, in its initial rotational and translational position, disc 50 is situated such that the tip of disc engaging member 53 is positioned adjacent to, but slightly below, the peripheral edge of leading flap 18. It is to be remembered that prior to the actuation of the leading flap opening apparatus, the movement of case 12 along the conveyor system has been terminated, such that case 12 is stationary. The leading flap opening operation commences with the energization of air cylinder 42 which causes carriage 38 to begin its movement along tracks 34, 36. As carriage 38 moves along tracks 34, 36, pinion gear 48, which meshes with rack 52 fixedly mounted to track 34, causes disc 50 to rotate in a clockwise direction.

The rotational and translational movement of flap engaging disc 50 causes member 53 to engage the underside of leading flap 18 and pivot same towards the opened position. As this occurs, the tip of member 53 moves relative to the underside of flap 18 towards the fold line between the flap and the corner of the case to which the flap is mounted. At the same time, the peripheral edge of flap 18 extends within the flap clearance recess in disc 50. This is illustrated in phantom in FIG. 4. Further movement of disc 50 causes the flap to be situated in a substantially vertical position wherein the flap is no longer in the recess and the underside of the flap engages the outer peripheral edge of member 53. Still further movement of disc 50 causes the disc to be situated in the position illustrated in FIGS. 5 and 6. At this point, flap engaging disc 50 has completed its rotational and translational motion and carriage 38 is in its second position at the end of tracks 34, 36, farthest from cylinder 42.

Figure 5:
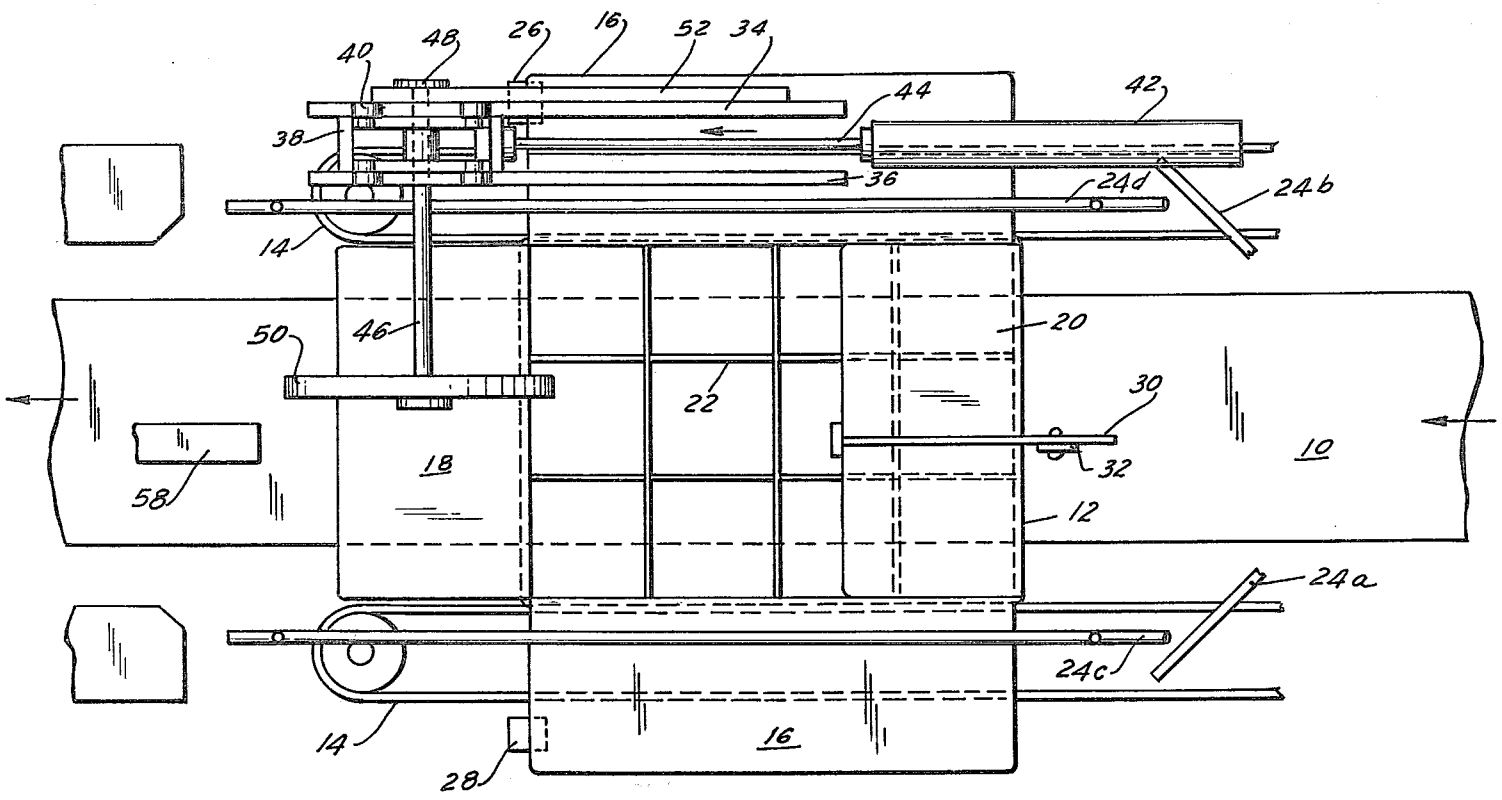
FIG. 5 is a top elevational view of the case opening apparatus of the present invention, illustrating the latter portion of the leading flap opening operation.
Figure 6:
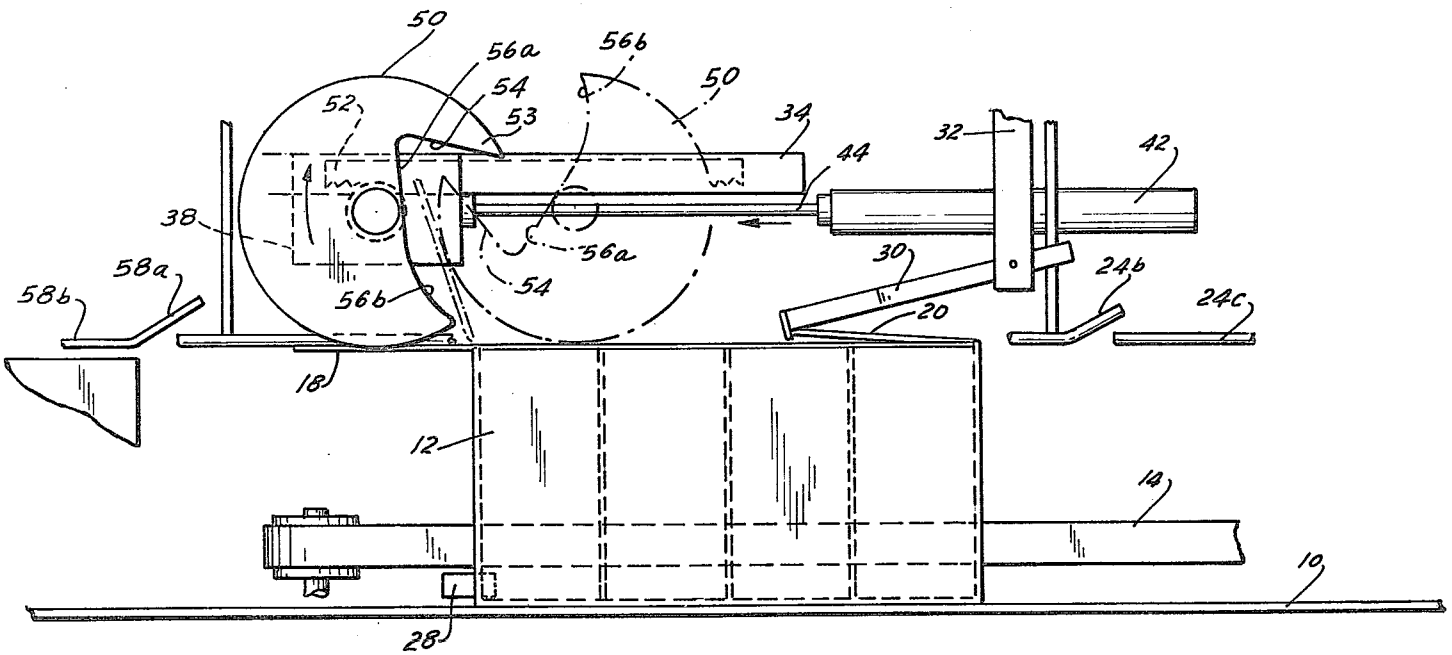
FIG. 6 is a side elevational view of the portion of the leading flap opening operation illustrated in FIG. 5.

To illustrate the translational and rotational positions of flap engaging disc 50 during the leading flap opening operation, two intermediate positions of disc 50 have been illustrated in phantom, one in FIG. 4 and one in FIG. 6. The translational and rotational position of flap engaging disc 50, when the carriage 38 is in the second position at the end of the path of travel, is illustrated in FIG. 5, and in solid in FIG. 6.

While FIG. 1 contains four separate representations of case 12, it is to be understood that these representations illustrate only three different positions of case 12. The middle two representations of case 12 show case 12 in the same position with respect to belt 10, but illustrate the movement of carriage 38 relative to this position. Thus, the middle two representations illustrate the initial and last positions of the carriage during the leading flap opening operation, during which the case 12 is held in a stationary position relative to belt 10.

When carriage 38 reaches the translational position along tracks 34, 36, as illustrated in FIGS. 5 and 6, leading flap 18 is in the completely opened position and the leading flap opening operation is completed. At the end of its stroke, cylinder 42 automatically reverses direction, causing carriage 38 to move along tracks 34, 36 to its original position. Simultaneously with the initiation of the return stroke of cylinder 42, the conveyor system is reactuated, such that case 12 again moves relative to the case opening apparatus. The reactuation of the conveyor system initiates the third operation which results in the opening of the trailing flap 20.

It should be appreciated that during the opening of the trailing flap 20, it is necessary to maintain leading flap 18 in the opened position. In order to provide this function, a member 58 is provided which is suspended either from the overhead or side portions of the support frame (not shown), such that it is situated immediately above the surface of case 12 along the path of movement thereof. Member 58 has an inclined portion 58*a* and a generally horizontal portion 58*b*. As leading flap 18, in the opened position, is released from engagement from the periphery of flap engaging disc 50, it will have a tendency to move at least partially back to the closed position. In order to prevent this, as flap 18 is disengaged from the periphery of flap engaging disc 50, the peripheral edge thereof will abut the undersurface of portion 58*a* of member 58. Movement of case 12 along conveyor belt 10 cause the peripheral edge of leading flap 18 to move along the undersurface of portion 58*a* of member 58, until same passes under horizontal portion 58*b* of member 58 which extends along the remainder of the apparatus and serves to maintain leading flap 18 in the opened position.

It should be recalled that at the point in time when the movement of conveyor belt 10 was terminated, such that the leading flap opening operation could take place, a pivotally mounted hook 30 was situated in engagement with the peripheral edge of trailing flap 20. When conveyor belt 10 is reactuated after the leading flap opening operation has been completed, the movement of case 12 relative to hook 30 will cause the trailing flap 20 to be opened at leading flap 20 pivots around the corner of case 12 to which same is mounted, and hook 30 pivots with respect to support 32.

Figure 7:
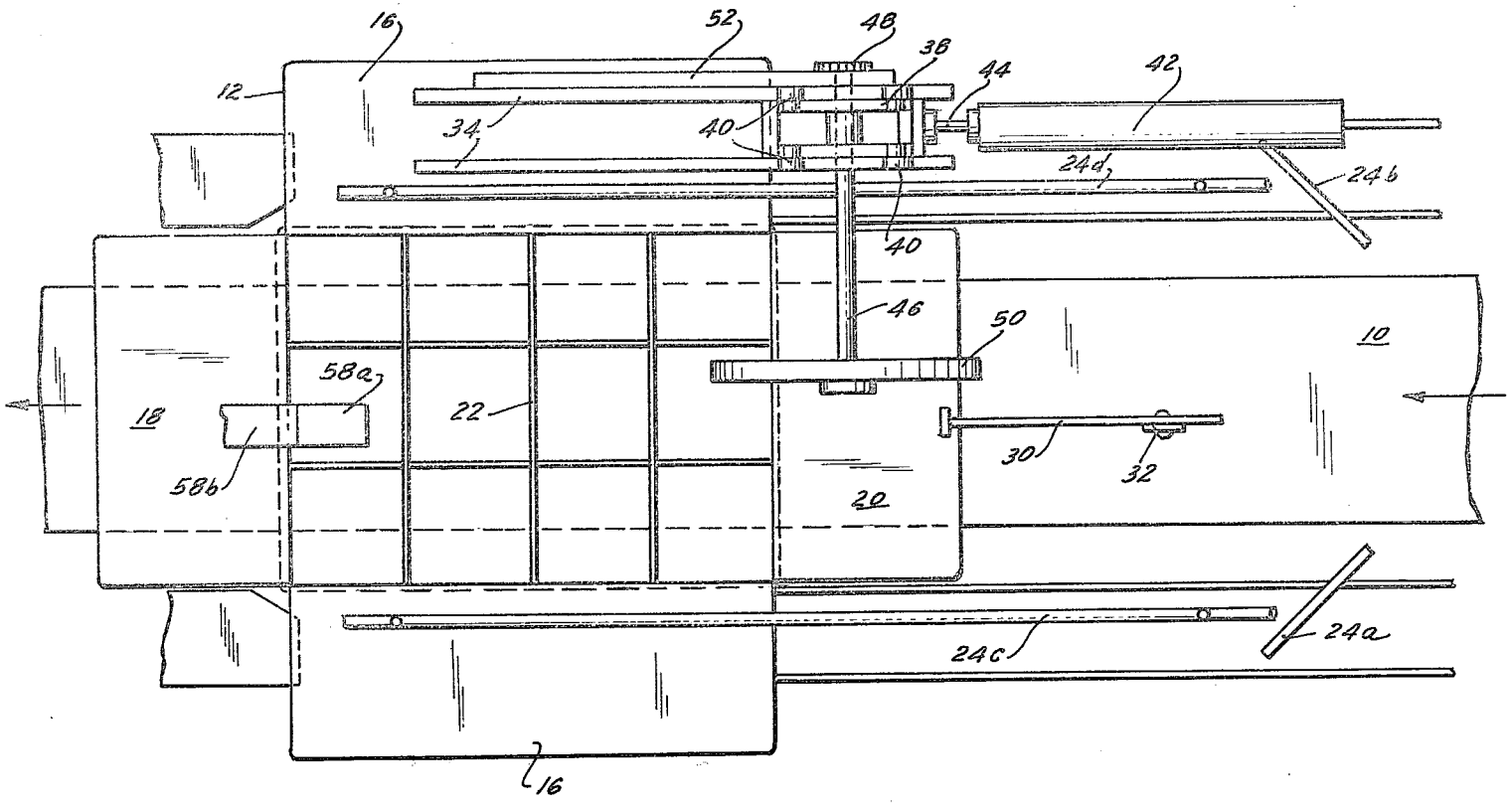
FIG. 7 is a top elevational view of the case opening apparatus of the present invention, illustrating the trailing flap opening operation.

FIG. 7 illustrates the apparatus after the third operation has been completed. In this position, trailing flap 20 has been completely opened by hook 30 and will thereafter pass beneath flap engaging disc 50, which is now in its initial translational and rotational position. Further movement of case 12 along conveyor 10 will cause trailing flap 20 to first disengage from hook 30 and then disengage the peripheral surface of disc 50. At this point, the trailing flap 20 may move a short distance towards its closed position. However, when the carton reaches a position where trailing flap 20 engages member 58, the inclined portion 58*a* of member 58 will engage the trailing flap 20 and the shape of member 58 will cause the trailing flap 20 to reassume the opened position. Thus, as case 12 leaves the case opening apparatus, the leading flap 18, trailing flap 20 and side flaps 16 are completely opened and the case loading operation may take place without interference from the flaps.

It will now be appreciated that the present invention relates to a case opening apparatus and, more particularly, to a leading flap opening mechanism of simplified design which acts reliably to open the leading flap of a case. The leading flap opening mechanism contains a minimum of moving parts and includes a flap engaging disc which is carried on a movable carriage. The translational and rotational movement of the disc relative to the stationary case results from the movement of the carriage by means of an air cylinder or the like. The apparatus is relatively inexpensive to produce and maintain, because of the simplicity thereof, and is designed to be used in conjunction with side flap opening and trailing flap opening mechanisms.

While only a single embodiment of the present invention has been disclosed herein for purposes of illustration, it is obvious that many modifications and variations could be made thereto. It is intended to cover all of these variations and modifications which fall within the scope of the present invention, as defined by the following claims:

I claim:

1. Apparatus for opening the leading flap of a case or the like, said apparatus comprising a track, a rack fixedly mounted on said track and comprising a plurality of gear teeth, a carriage mounted on said track for movement with respect thereto, means for moving said carriage along said track, a pinion gear mounted on said carriage in operable engagement with said rack, said gear being rotated as said carriage is moved along said track; flap engaging means and means for operably connecting said flap engaging means to said pinion for rotation therewith, said carriage being movable relative to said track to cause said flap engaging means to be displaced and rotated relative to the case to engage the closed leading flap and to move same from the closed position to an opened position.

2. The apparatus of claim 1, further comprising means for moving the case relative to said track and means for deactuating said case moving means as said carriage moving means is actuated.

3. The apparatus of claim 2, wherein said carriage movement is in a direction generally parallel to the direction of movement of the case along said case moving means.

4. The apparatus of claim 2, wherein said track extends alongside said case moving means in a direction substantially parallel thereto.

5. The apparatus of claim 4, wherein said track is situated above the plane of the upper surface of the case.

6. The apparatus of claim 1, wherein said connecting means is a shaft extending from said carriage at least partially over the upper surface of said case.

7. The apparatus of claim 6, wherein said flap engaging means is mounted on said shaft.

8. The apparatus of claim 1, wherein said flap engaging means comprises a disc.

9. The apparatus of claim 8, wherein said disc comprises a flap engaging member and a flap clearance recess.

10. The apparatus of claim 9, wherein said recess is defined in part by the generally linear surface of said member.

11. The apparatus of claim 10, wherein said member surface is substantially perpendicular to the radius of said disc passing through the junction between the surfaces defining the recess.

12. The apparatus of claim 9, wherein said recess is defined in part by a surface comprising an arcuate section.

13. The apparatus of claim 10, wherein said recess is defined in part by a second surface and wherein said second surface forms an acute angle with said member surface.

14. The apparatus of claim 12, wherein said arcuate section is shaped to provide clearance for the flap as same is moved from the closed position to the opened position.

15. The apparatus of claim 1, further comprising means for opening the side flaps of the case.

16. The apparatus of claim 15, wherein said side flap opening means comprises a plow.

17. The apparatus of claim 1, further comprising means for opening the trailing flap of the case.

18. The apparatus of claim 17, wherein said trailing flap opening means comprises a hook.

19. The apparatus of claim 15, further comprising means for opening the trailing flap of the case.

* * * * *